US010753030B2

(12) United States Patent
Davis

(10) Patent No.: US 10,753,030 B2
(45) Date of Patent: Aug. 25, 2020

(54) WASHING MACHINE APPLIANCES AND METHODS OF USING COUNTERWEIGHT AMPLITUDE TO LIMIT BASKET SPEED

(71) Applicant: Haier US Appliance Solutions, Inc., Wilmington, DE (US)

(72) Inventor: Paul Owen Davis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 166 days.

(21) Appl. No.: 16/032,125

(22) Filed: Jul. 11, 2018

(65) Prior Publication Data

US 2020/0018007 A1 Jan. 16, 2020

(51) Int. Cl.

| | |
|---|---|
| ***D06F 37/20*** | (2006.01) |
| ***D06F 37/26*** | (2006.01) |
| *D06F 37/30* | (2020.01) |
| *D06F 23/02* | (2006.01) |
| *D06F 37/04* | (2006.01) |

(52) U.S. Cl.

CPC ..... *D06F 37/203* (2013.01); *D06F 37/268* (2013.01); *D06F 23/02* (2013.01); *D06F 37/04* (2013.01); *D06F 37/269* (2013.01); *D06F 37/302* (2013.01)

(58) Field of Classification Search

None

See application file for complete search history.

(56) References Cited

U.S. PATENT DOCUMENTS

| | | | | |
|---|---|---|---|---|
| 6,783,675 | B1 | 8/2004 | Sans Rovira Ramon et al. | |
| 8,341,787 | B2 | 1/2013 | Kim et al. | |
| 8,930,031 | B2 * | 1/2015 | Wong | D06F 35/007 700/279 |
| 2013/0118210 | A1 * | 5/2013 | Wee | D06F 33/00 68/12.06 |
| 2014/0115793 | A1 | 5/2014 | Hamin et al. | |

FOREIGN PATENT DOCUMENTS

| | | | |
|---|---|---|---|
| CN | 105442244 | A | 3/2016 |
| DE | 19616985 | A1 * | 10/1997 |
| EP | 1342826 | * | 9/2003 |

OTHER PUBLICATIONS

English translation of DE19616985A1.*

* cited by examiner

*Primary Examiner* — Michael E Barr
*Assistant Examiner* — Jason P Riggleman
(74) *Attorney, Agent, or Firm* — Dority & Manning, P.A.

(57) ABSTRACT

A washing machine appliance, including one or more methods of operation, is provided herein. The washing machine appliance includes a wash basket rotatably mounted within a wash tub and being supported by a front bearing and a rear bearing. A method of operating the washing machine appliance includes rotating the wash basket within the wash tub at a basket speed and obtaining a front displacement amplitude, a rear displacement amplitude, and a wobble angle of the wash tub. Based at least in part on these measured values, front and rear bearing force amplitude thresholds and virtual bearing force values are calculated and compared. If the virtual bearing force value of either the front or rear bearing exceeds the respective bearing force amplitude threshold, an operating parameter of the washing machine appliance is adjusted to limit bearing forces resulting from out-of-balance loads.

20 Claims, 7 Drawing Sheets

WASHING MACHINE APPLIANCES AND METHODS OF USING COUNTERWEIGHT AMPLITUDE TO LIMIT BASKET SPEED

FIELD OF THE INVENTION

The present subject matter relates generally to washing machine appliances, such as horizontal axis washing machine appliances, and methods for monitoring load balances and limiting the basket speed in such washing machine appliances.

BACKGROUND OF THE INVENTION

Washing machine appliances generally include a cabinet which receives a wash tub for containing water or wash fluid (e.g., water and detergent, bleach, or other wash additives). The wash tub may be suspended within the cabinet by a suspension system to allow some movement relative to the cabinet during operation. A basket is rotatably mounted within the wash tub and defines a wash chamber for receipt of articles for washing. During normal operation of such washing machine appliances, the wash fluid is directed into the wash tub and onto articles within the wash chamber of the basket. A drive assembly is coupled to the wash tub and configured to rotate the wash basket within the wash tub to agitate articles within the wash chamber, to wring wash fluid from articles within the wash chamber, etc.

A significant concern during operation of washing machine appliances is the balance of the tub during operation. For example, articles and water loaded within a basket may not be equally weighted about a central axis of the basket and tub. Accordingly, when the basket rotates, in particular during a spin cycle, the imbalance in clothing weight may cause the basket to be out-of-balance within the tub, such that the axis of rotation does not align with the cylindrical axis of the basket or tub. Such out-of-balance issues can cause the basket to contact the tub during rotation and can further cause movement of the tub within the cabinet. Significant movement of the tub can, in turn, generate increased noise and vibrations and/or cause excessive wear and premature failure of appliance components.

Various methods are known for monitoring load balances and preventing out-of-balance scenarios within washing machine appliances. Such monitoring and prevention may be especially important, for instance, during the high-speed rotation of the wash basket, e.g., during a spin cycle. For example, conventional systems monitor motor current or rotational velocity to determine when articles within the tub are in a suitable position for a spin cycle. Alternatively, one or more balancing rings may be attached to the rotating basket to provide a rotating annular mass that minimizes the effects of imbalances. However, such systems often fail to accurately determine the position of articles within the tub or basket or detect an out-of-balance condition. Moreover, such systems often require additional components and/or sensors, thereby increasing the cost and complexity of the appliance.

Accordingly, improved methods and apparatuses for monitoring load balance in washing machine appliances are desired. In particular, methods and apparatuses that provide for accurate detection of a balanced state or compensation for an imbalanced state during a washing operation would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method for operating a washing machine appliance is provided. The washing machine appliance has a wash tub, a wash basket rotatably mounted within the wash tub by a drive shaft, and a front bearing and a rear bearing for supporting the drive shaft. The method includes rotating the wash basket within the wash tub at a basket speed, obtaining at least one displacement amplitude of the wash tub, obtaining a wobble angle of the wash tub, and determining a bearing force amplitude threshold. The method further includes calculating a virtual bearing force value based in part on at least one of the displacement amplitude and the wobble angle, determining that the virtual bearing force value is greater than the bearing force amplitude threshold, and adjusting at least one operating parameter of the washing machine appliance in response to determining that the virtual bearing force value is greater than the bearing force amplitude threshold.

In another exemplary aspect of the present disclosure, a washing machine appliance is provided including a cabinet, a wash tub positioned within the cabinet, a measurement device operably coupled to the wash tub, and a wash basket rotatably mounted within the wash tub by a drive shaft supported by a front bearing and a rear bearing. A drive assembly is in mechanical communication with the wash basket for rotating the wash basket and a controller is communicatively coupled to the drive assembly and the measurement device. The controller is configured for rotating the wash basket within the wash tub at a basket speed, obtaining a front displacement amplitude and a rear displacement amplitude of the wash tub using the measurement device, and obtaining a wobble angle of the wash tub. The controller is further configured for determining a front bearing force amplitude threshold and a rear bearing force amplitude threshold, calculating a front virtual bearing force value and a rear virtual bearing force value based in part on at least one of the front displacement amplitude, the rear displacement amplitude, and the wobble angle, determining that the front virtual bearing force value is greater than the front bearing force amplitude threshold or the rear virtual bearing force value is greater than the rear bearing force amplitude threshold, and adjusting at least one operating parameter of the washing machine appliance in response to determining that the front virtual bearing force value is greater than the front bearing force amplitude threshold or the rear virtual bearing force value is greater than the rear bearing force amplitude threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
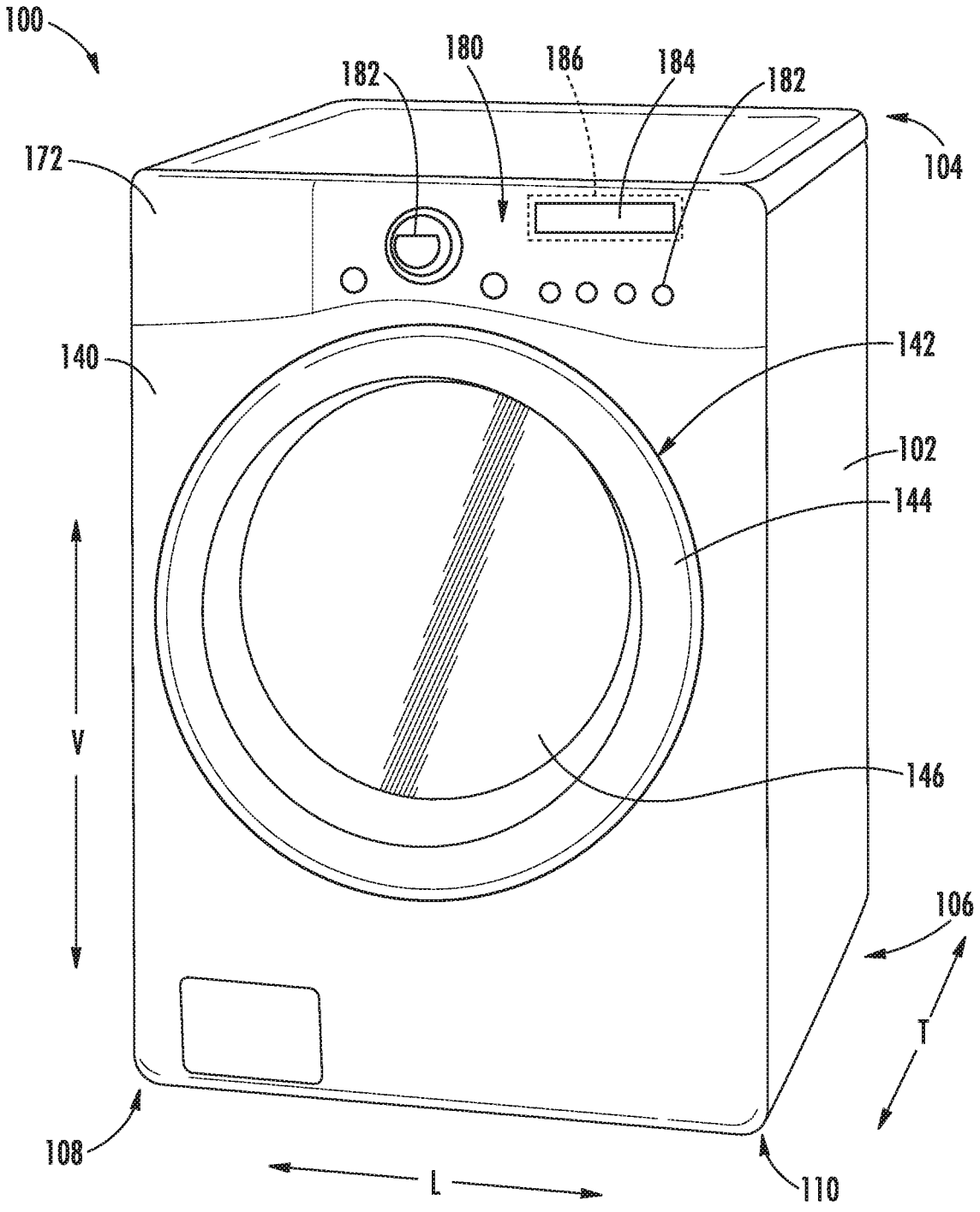
FIG. 1 provides a perspective view of a washing machine appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Furthermore, it should be appreciated that as used herein, terms of approximation, such as "approximately," "substantially," or "about," refer to being within a ten percent margin of error.

Figure 2:
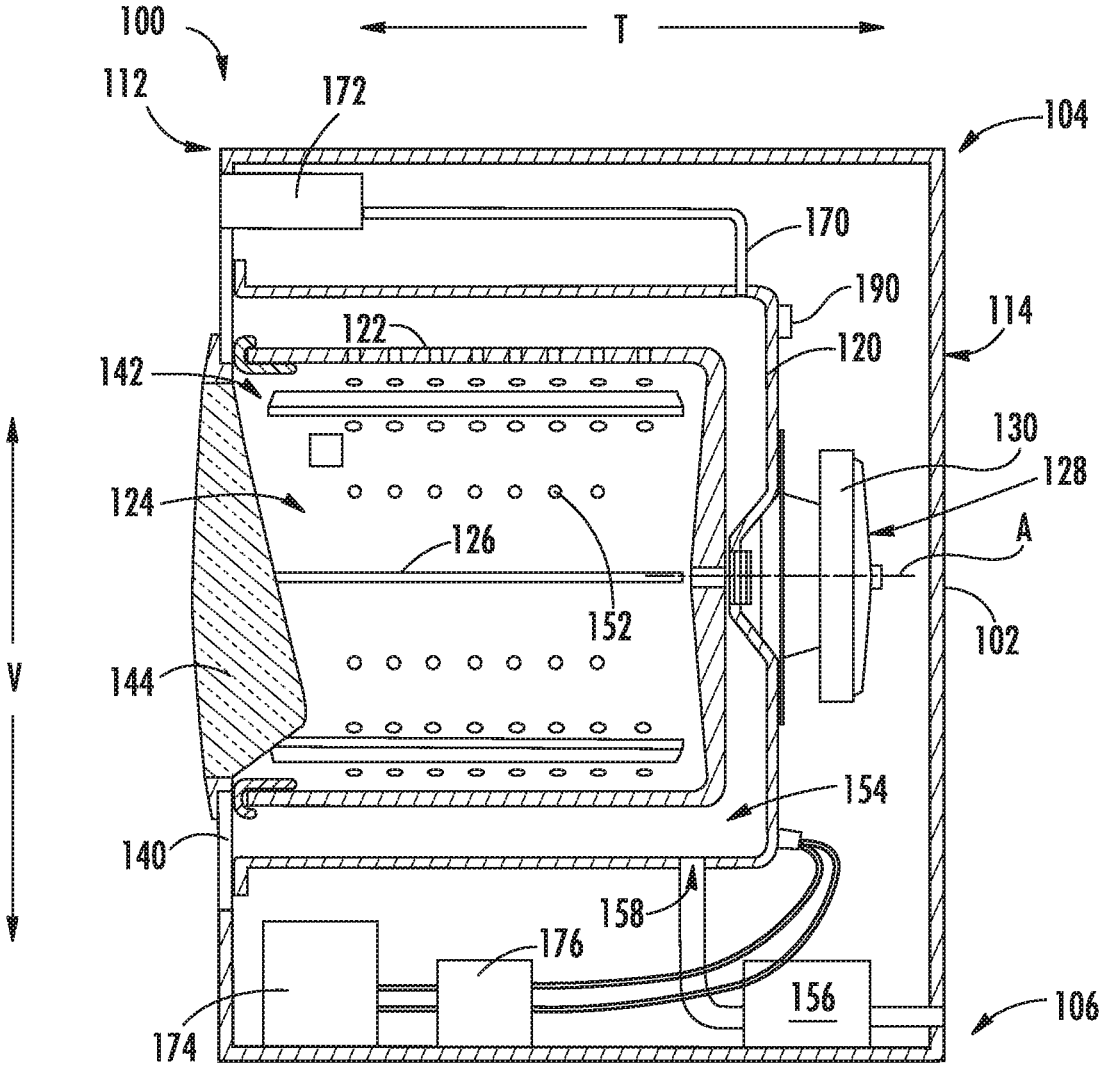
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation A. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Figure 4:
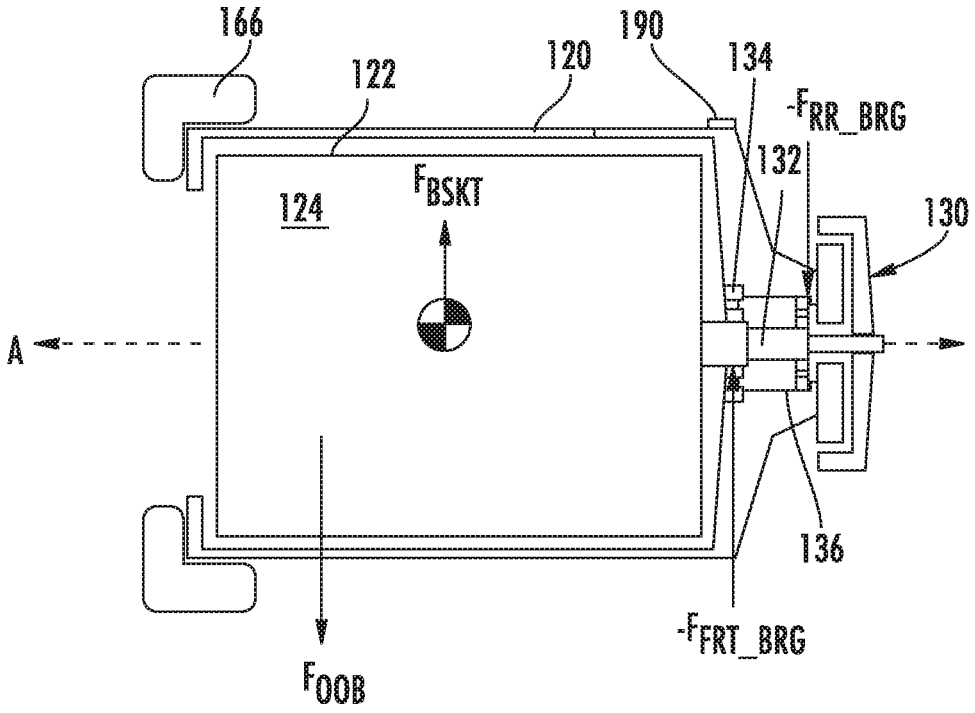
FIG. 4 provides a schematic side view of components of a washing machine appliance in accordance with exemplary embodiments of the present disclosure.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIGS. 2 and 4, drive assembly 128 may include a motor assembly 130 that is in mechanical communication with wash basket 122 via a drive shaft 132 to selectively rotate wash basket 122 (e.g., during an agitation or a rinse cycle of washing machine appliance 100). In addition, drive shaft 132 is pricipally rotatably supported by a front bearing 134 and a rear bearing 136. According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122 of wash tub 120. More specifically, washing machine appliance 100 includes a door 144 that is positioned over opening 142 and is rotatably mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments. Additionally or alternatively, a front gasket or baffle (not shown) may extend between tub 120 and the front panel 140 about the opening 142 covered by door 144, further sealing tub 120 from cabinet 102.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120.

Figure 3:
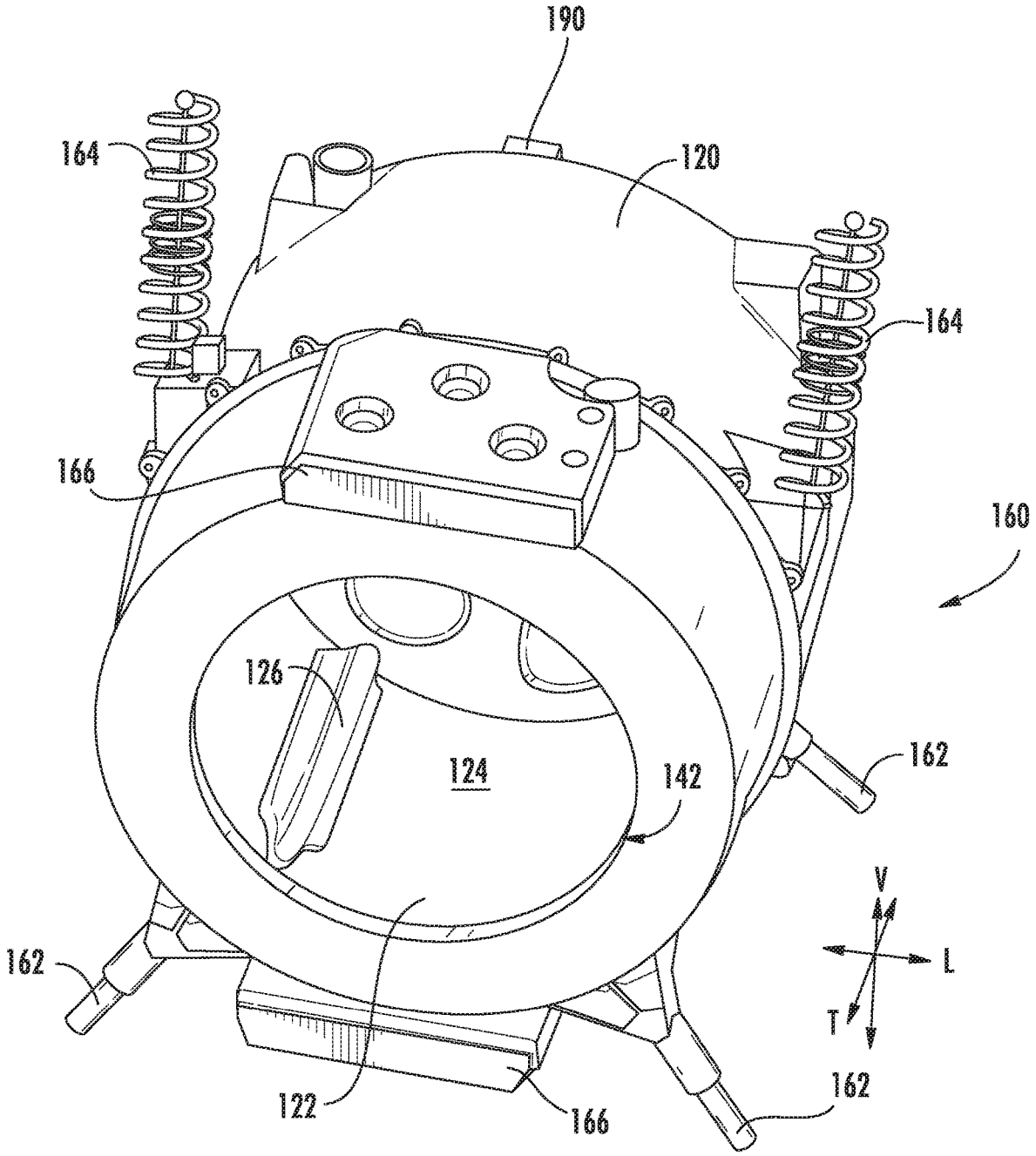
FIG. 3 provides a perspective view of a portion of the exemplary washing machine appliance, wherein the cabinet has been removed for clarity.

Turning briefly to FIG. 3, basket 122 and tub 120 are supported within cabinet 102 by a vibration damping system or suspension system 160. Suspension system 160 generally operates to damp or reduce dynamic motion and absorb vibrations resulting from the movement of wash basket 122 within the tub 120. Suspension system 160 can include one or more damper assemblies 162 coupled between and to the cabinet 102 and wash tub 120 (e.g., at a bottom portion or bottom 106 of wash tub 120). Typically, four damper assemblies 162 are utilized, and are spaced apart about the wash tub 120. For example, each damper assembly 162 may be connected at one end proximate to a bottom corner of the cabinet 102.

Additionally or alternatively, washing machine appliance 100 can include other vibration damping elements, such as one or more suspension springs 164. According to the illustrated embodiment, suspension system 160 includes two suspension springs 164 that extend between top 104 of cabinet 102 and sides of wash tub 120, e.g., to be fixed at a location proximate to but above a center of gravity of wash tub 120. In optional embodiments, suspension system 160 (and washing machine appliance 100, generally) is free of any annular balancing rings, which would add an evenly-distributed rotating mass on basket 122.

Still referring to FIG. 3, according to an exemplary embodiment, washing machine appliance 100 may further include one or more counterweights 166. For example, according to the illustrated embodiment, counterweights 166 are mounted to a front of the wash tub 120, both at the top and the bottom. However, according to alternative embodiments, any suitable number, size, and position of counterweights may be used. In general, counterweights 166 are configured for offseting the weight of motor assembly 130, thereby moving the center of gravity of wash tub 120 closer to its longitudinal center. In this manner, the balance and stability of the wash tub 120 within cabinet 102 is improved.

Returning to FIGS. 1 and 2, in some embodiments, washing machine appliance 100 includes an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In optional embodiments, a bulk reservoir 174 is disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 is configured for selective delivery of the fluid additive from bulk reservoir 174 to wash tub 120.

A control panel 180 including a plurality of input selectors 182 is coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. As described in more detail below with respect to FIG. 8, controller 186 may include a memory and microprocessor, such as a general or special purpose microprocessor operable to execute programming instructions or micro-control code associated with methods described herein. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 and other components of washing machine appliance 100 may be in communication with controller 186 via one or more signal lines or shared communication busses.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation A at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before be rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

Referring now to FIGS. 3 through 6, one or more measurement devices 190 may be provided in the washing machine appliance 100 for measuring movement of the tub 120, in particular during rotation of articles in the spin cycle of the washing operation. Measurement devices 190 may measure a variety of suitable variables that can be correlated to movement of the tub 120. The movement measured by such devices 190 can be utilized to, e.g., monitor the load balance state of the tub 120, determine the displacement amplitudes of wash tub 120 at various locations, and to adjust operation of washing machine appliance to prevent excessive wear or damage to bearings 134, 136 or other components of washing machine appliance 100.

A measurement device 190 in accordance with the present disclosure may include an accelerometer which measures translational motion, such as acceleration along one or more directions. Additionally or alternatively, a measurement device 190 may include a gyroscope, which measures rotational motion, such as rotational velocity about an axis. Moreover, according to exemplary embodiments, a measurement device 190 may include more than one gyroscope and/or more than one accelerometer.

Control panel 180 and other components of washing machine appliance 100, such as motor assembly 130 and measurement device 190, may be in communication with controller 186 via one or more signal lines or shared communication busses. Optionally, measurement device 190 may be included with controller 186 or may alternatively be a printed circuit board that includes the gyroscope and accelerometer thereon. According to exemplary embodiments, measurement devices 190 may include a dedicated microprocessor that performs the calculations specific to the measurement of motion with the calculation results being used by controller 186.

According to the illustrated embodiment, measurement device 190 is mounted to the tub 120 to sense movement of the tub 120 relative to the cabinet 102, e.g., by measuring uniform periodic motion, non-uniform periodic motion, or excursions of the tub 120 during appliance 100 operation. For instance, movement may be measured as discrete identifiable components (e.g., in a predetermined direction). More specifically, according to the illustrated embodiment, measurement device 190 is mounted at a rear of wash tub 120, e.g., to facilitate simple wiring, improved assembly and rigidity, and reduced likelihood of damage. As explained herein, positioning measurement device 190 on wash tub 120 may permit controller 186 to determine the movement of any other position on wash tub 120. However, it should be appreciated that according to alternative embodiments, any suitable number, type, and position of measurement devices may be used.

The measurement device 190 may be mounted to the tub 120 (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments are advantageously mounted to the tub 120 at a single location (e.g., the location of the printed circuit board or other component of the measurement device 190 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on tub 120 can measure the rotation of an accelerometer located at a different location on tub 120, because rotation about a given axis is the same everywhere on a solid object such as tub 120.

An exemplary method of using measurement device 190 to set limit thresholds on the motion caused by an unbalanced wash load will now be described in detail. Specifically, the exemplary embodiment describes a method for determining two limit thresholds without consideration of the size or location of the unbalanced mass. Instead of determining the size of the unbalanced mass (as done in many prior control algorithms), the present method used a maximum force to be allowed at each of the bearings supporting the drive shaft which supports and rotates the wash basket. More specifically, continuing the example from above, measurement device 190 is used to monitor the motion of wash tub 120 and for determining the forces that motion generates at both front bearing 134 and rear bearing 136. In the event the motion generates a force that exceeds a predetermined threshold for either of these bearings 134, 136, washing machine appliance 100, or more specifically controller 186, takes corrective action to reduce or eliminate stress on the bearings 134, 136 or other appliance components.

Figure 5:
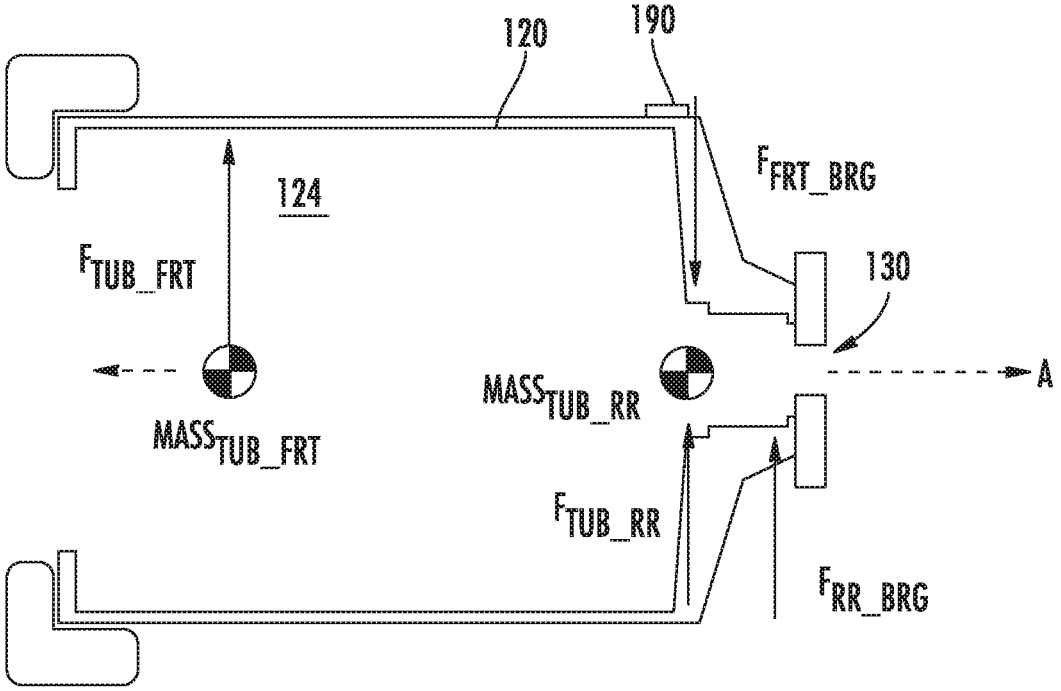
FIG. 5 provides a schematic side view of components of a washing machine appliance in accordance with exemplary embodiments of the present disclosure.
Figure 6:
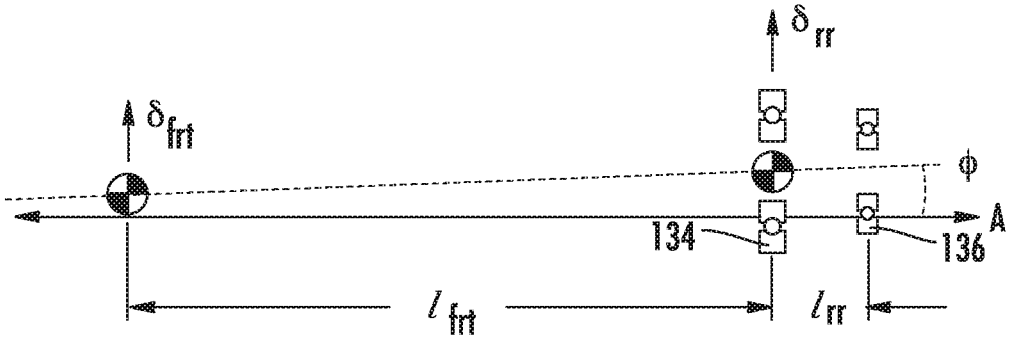
FIG. 6 provides a schematic representation of the forces acting on a wash tub of the exemplary washing machine appliance of FIG. 1 according to an exemplary embodiment of the present subject matter.

Referring now specifically to FIGS. 4 through 6, schematic representations of a washing machine appliance and forces acting on the washing machine appliance during operation are illustrated. Specifically, continuing the example from above, the forces acting on wash tub 120, wash basket 122, front bearings 134, and rear bearings 136 are illustrated. In this regard, wash tub 120 and wash basket 122 are illustrated as and may be referred to herein as a "suspended mass" of a front load washing machine appliance 100 wherein wash tub 120 support wash basket 122 by drive shaft 132 and bearings 134, 136. In general, the methods described herein are intended to limit the forces acting on bearings 134, 136 to prevent premature failure.

As shown in FIG. 4, out-of-balance force ($F_{OOB}$) acts on wash tub 120 proximate a front of wash tub 120 and has some amplitude. However, in practice, both the location and amplitude of the out-of-balance force is, in practice, unknown. Some washing machine appliances use sensor systems to estimate the location and amplitude of the out-of-balance force ($F_{OOB}$) and make appropriate corrections. However, the present method may limit the basket speed in response to exceeding limit thresholds determined absent knowledge of the size or location of the unbalanced mass and thus the out-of-balance force ($F_{OOB}$).

For purposes of the present method, the suspended mass of washing machine appliance 100 is separated into parts convenient for the purpose of showing how the forces at the shaft bearings 134, 136 have the same magnitude at equilibrium whether they are acting on the rotating mass (i.e., wash basket 122) from one side of the bearings or on the non-rotating mass (i.e., wash tub 120) from the other side. The spinning out-of-balance mass has a centrifugal force ($F_{OOB}$) that causes the acceleration of all other suspended masses, e.g., wash tub 120 and wash basket 122, to reach equilibrium with the out-of-balance force ($F_{OOB}$). Thus, the masses undergoing acceleration produce a collective force equal to and opposite of the out-of-balance force ($F_{OOB}$). Specifically, as illustrated in FIG. 4, the out-of-balance force ($F_{OOB}$) is equal and opposite of the sum of the basket force ($F_{BSKT}$), the front bearing force ($F_{rr_brg}$), and the rear bearing force ($F_{rr_brg}$) at equilibrium.

To simplify the calculation of the bearing forces ($F_{rr_brg}$, $F_{rr_brg}$) as a function of motion of the mass of wash tub, the tub mass 120 is broken into two equivalent masses—one mass that is in the plane at the rear of the tub ($mass_{rr}$, $F_{TUB\text{-}RR}$) at the front bearing 134 and one mass that is located at the front of the tub ($mass_{frt}$, $F_{TUB_FRT}$), e.g., proximate the counterweights. The location of the front mass is determined so that the two split masses combined are equivalent to the total tub mass in its actual location. For a given system, $mass_{rr}$ and $mass_{frt}$ are known constants. Upon simplifying the location and forces exerted within washing machine appliance 100, the forces may be represented as shown in FIG. 5.

Referring now specifically to FIG. 6, two position dimensions and two motion displacement amplitudes are illustrated on wash tub 120. In this regard, the front displacement ($\delta_{frt}$) and rear displacement ($\delta_{rr}$) are unsigned displacement amplitudes of the orbital motion in the plane normal to axis of rotation A. According to the illustrated embodiment, the front displacement ($\delta_{frt}$) is measured at a front distance ($l_{frt}$) from where rear displacement ($\delta_{rr}$) is measured (e.g., at front bearing 134) along the axis of rotation A. In addition, rear displacement ($\delta_{rr}$) is measured at a rear distance ($l_{rr}$) from rear bearing 136 as shown schematically in FIG. 6.

The front displacement ($\delta_{frt}$) and the rear displacement ($\delta_{rr}$) may be referred to herein as "virtual point amplitudes." In this regard, virtual point amplitudes are intended to refer to displacement or motion measurements at a location that does not include a measurement device. Virtual point amplitudes may generally be determined by estimation assuming wash tub 120 is a rigid body and knowing the dimensional configuration of wash tub 120. Notably, by using dimensional knowledge and making such assumptions, the position or motion of any point, including points away from the place where the measurement device is located, may be predicted based on the measured position or motion at the measured location. In this manner, washing machine appliance 100 need not include multiple measurement devices while still maintaining the motion of each point on wash tub 120. It should be appreciated that the front displacement ($\delta_{frt}$) and rear displacement ($\delta_{rr}$) may be actual measured displacements or virtual point amplitudes according to various embodiments of the present subject matter.

In addition, an angular displacement amplitude ($\Phi$), also referred to as the wobble angle, is determined. Wobble angle ($\Phi$) may represent the conical angle of the cylindrical axis of wash basket 122 relative to the axis of rotation A (FIG. 6) when wash tub 120 is in an unbalanced state. Wobble angle ($\Phi$) may be measured or determined using the gyroscope of measurement device 190 (e.g., via integration of detected rotational velocity data).

The front distance ($l_{frt}$) and rear distance ($l_{rr}$) are known values based on appliance geometry. In addition, the value of front displacement ($\delta_{frt}$), rear displacement ($\delta_{rr}$), and wobble angle ($\Phi$) may all be determined using measurement sensor 190 and the known geometry of washing machine appliance 100, as would be appreciated by one skilled in the art.

According to an exemplary embodiment, using the modeled forces described above and as illustrated in FIGS. 5 and 6, a formulation of the forces acting on the bearings 134, 136 will be described below according to an exemplary embodiment. Specifically, the rear bearing force ($F_{rr_brg}$) can be found from the summation of moments around front bearing 134 as a function of the basket speed ($\omega$) measured in radians per second, as set forth in the equation below:

$$\Sigma M=0=\omega^2\delta_{frt}mass_{frt}l_{frt}-F_{rr_brg}l_{rr}$$

According to an exemplary embodiment, the rotational velocity of wash basket 122 or basket speed ($\omega$) may be measured at motor assembly 130 in rotations per minute or radians per second. Thus, the rear bearing force ($F_{RR_BRG}$) may be calculated as follows:

$$F_{rr_brg}=\omega^2\delta_{frt}mass_{frt}\left(\frac{l_{frt}}{l_{rr}}\right)$$

According to an exemplary embodiment, using the modeled forces described above and as illustrated in FIGS. 5 and 6, the front bearing force ($F_{frt_brg}$) can also be calculated as a function of the basket speed ($\omega$) measured in radians per second from the summation of forces as follows:

$$\Sigma F=0=\omega^2\delta_{frt}mass_{frt}+\omega^2\cos(\beta)\delta_{rr}mass_{rr}+F_{frt_brg}+F_{rr_brg}$$

The term $\cos(\beta)\ \delta_{rr}$ in the equation above is the component of the rear displacement ($\delta_{rr}$) that is collinear to the front displacement ($\delta_{frt}$), e.g., after compensating for the wobble angle ($\Phi$). In this regard, $\cos(\beta)$ accounts for the phase angle between the front displacement ($\delta_{frt}$) and the rear displacement ($\delta_{rr}$), and may be calculated using the law of cosines as shown by the following equation:

$$\cos(\beta)=\frac{\delta_{frt}^2+\delta_{rr}^2-(\Phi\cdot l_{frt})^2}{2\delta_{frt}\delta_{rr}}$$

Notably, the front and rear displacements ($\delta_{frt}$, $\delta_{rr}$) and the wobble angle ($\Phi$) may be measured and the front distance ($l_{frt}$) is known, so the term $\cos(\beta)$ may be determined. Going further, substituting the rear bearing force ($F_{rr_brg}$) into the summation of forces equation above and simplifying results in the following equation:

$$\Sigma F=0=\omega^2\delta_{frt}mass_{frt}\left(1+\frac{l_{frt}}{l_{rr}}\right)+\omega^2\cos(\beta)\ \delta_{rr}mass_{rr}+F_{frt_brg}$$

Using this simplified summation of forces equation, the solution for the front bearing force ($F_{frt_brg}$) is as follows:

$$F_{frt_brg} = (-\omega)^2\left(\delta_{frt}\text{mass}_{frt}\left(1 + \frac{l_{frt}}{l_{rr}}\right) + \cos(\beta)\delta_{rr}\text{mass}_{rr}\right)$$

The purpose of the present control method is to determine an unsigned threshold or magnitude threshold for allowable displacements. Therefore, the above equation may be represented as follows:

$$|F_{frt_brg}| = \omega^2\left|\delta_{frt}\text{mass}_{frt}\left(1 + \frac{l_{frt}}{l_{rr}}\right) + \cos(\beta)\delta_{rr}\text{mass}_{rr}\right|$$

Simplify to get the following, where $C_1$ and $C_2$ are fixed constants:

$$|F_{frt_brg}| = \omega^2|\delta_{frt}C_1 + \cos(\beta)\delta_{rr}C_2|$$

where:

$$C_1 = \text{mass}_{frt}\left(1 + \frac{l_{frt}}{l_{rr}}\right); \text{ and}$$

$$C_2 = \text{mass}_{rr}$$

Now that equations for both the front bearing force ($F_{frt_brg}$) and the rear bearing force ($F_{rr_brg}$) have been formulated, a front bearing threshold ($AMP_{FRT}$) and a rear bearing threshold ($AMP_{RR}$) may be dependent on the force limit for the front bearing ($F_{LMT_FRT}$) and the force limit for the rear bearing ($F_{LMT_RR}$), respectively, along with the basket speed ($\omega$). This may be represented in operation using front and rear bearing threshold equations, referred to herein as "bearing threshold equations," as follows:

$$\text{AMP}_{FRT} = \frac{F_{LMT_FRT}}{\omega^2 C_3} \geq |\delta_{frt}C_4 + \cos(\beta)\delta_{rr}|$$

$$\text{AMP}_{RR} = \frac{F_{LMT_RR}}{\omega^2 C_5} \geq |\delta_{frt}|$$

where:

$$C_3 = \text{mass}_{rr};$$

$$C_4 = \frac{\text{mass}_{frt}}{\text{mass}_{rr}}\left(1 + \frac{l_{frt}}{l_{rr}}\right); \text{ and}$$

$$C_5 = \text{mass}_{frt}\left(\frac{l_{frt}}{l_{rr}}\right)$$

Notably, using the amplitude thresholds equations above, a lookup table may be generated based on the known values as a function of the basket speed ($\omega$). Specifically, for example, the bearing force limits ($F_{LMT_FRT}$, $F_{LMT_RR}$) may be determined empirically or may be provided by the bearing manufacturer and the system constants ($C_3$, $C_4$, $C_5$) may be determined based on wash tub 120 geometry and mass. Thus, the left hand side of the above equation may be determined as a function of the basket speed ($\omega$).

In this manner, for a given basket speed ($\omega$), an appliance controller may obtain from the lookup table an associated amplitude threshold for the front and rear bearings. Simultaneously, the controller may use a measurement device (such as measurement device 190) to measure the front displacement ($\delta_{frt}$), the rear displacement ($\delta_{rr}$), and the wobble angle ($\Phi$). Furthermore, the front distance ($l_{frt}$) and the rear distance ($L_{rr}$) may be known for a given appliance. Having these values permits a determination as to whether the displacements have exceeded the amplitude thresholds. Method 200 described below provides one exemplary method of limiting bearing forces using displacement amplitudes and the models described above.

Now that the construction of washing machine appliance 100 and the configuration of controller 186 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 186 or a separate, dedicated controller.

Figure 7:
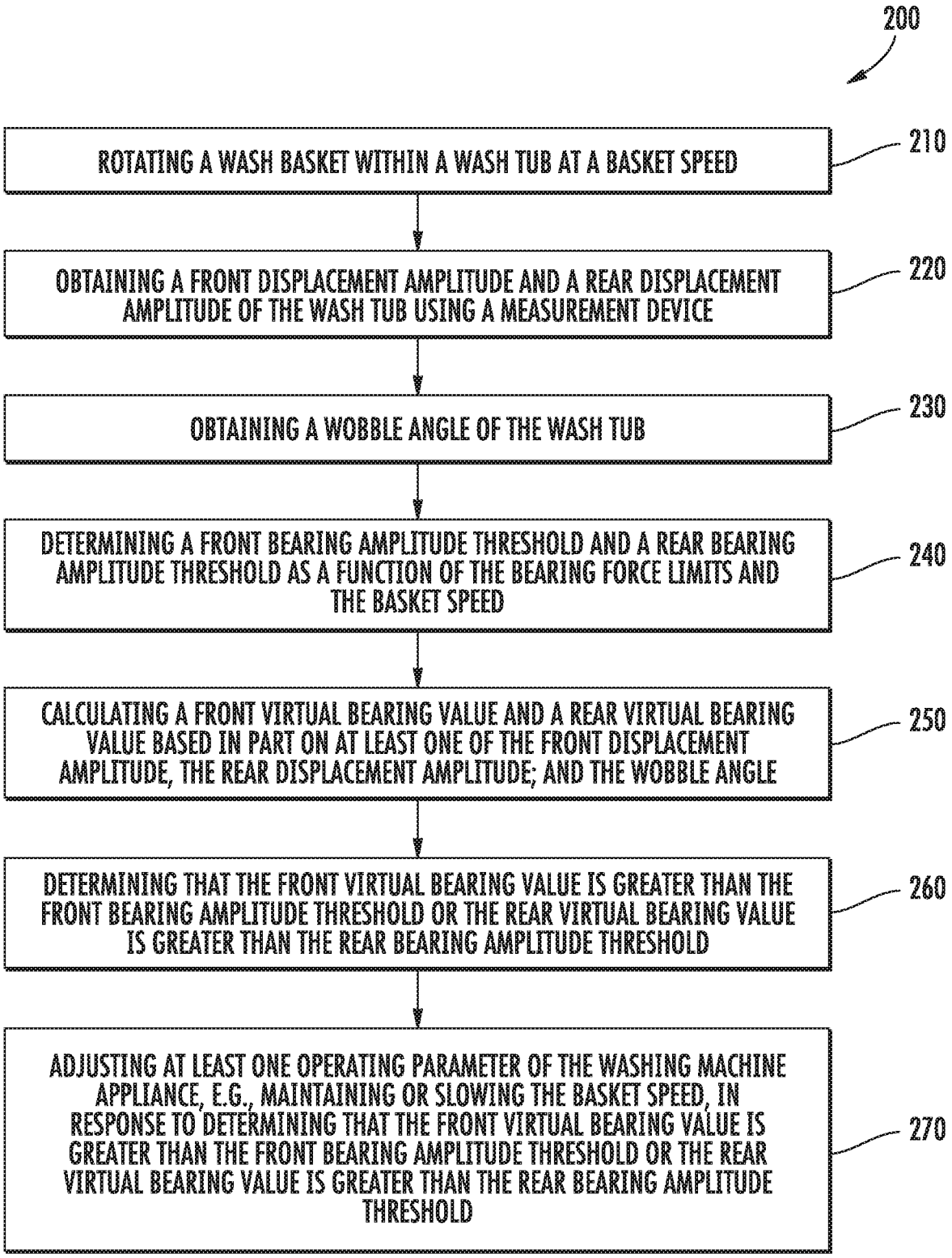
FIG. 7 illustrates a method for controlling a washing machine appliance in accordance with one embodiment of the present disclosure.

Referring now to FIG. 7, an exemplary method is described for use with washing machine appliances in accordance with the present disclosure. In general, the various steps of methods as disclosed herein may, in exemplary embodiments, be performed by the controller 186, which may receive inputs and transmit outputs from various other components of the appliance 100. In particular, the present disclosure is further directed to method, as indicated by reference number 200, for operating a washing machine appliance 100. Such methods advantageously facilitate monitoring of load balance states and wash tub displacements, determining when bearing forces have reached undesirable levels, and initiating corrective action to prevent excessive bearing forces. In exemplary embodiments, such balancing is performed during the spin cycle, following one or more of a draining, wash cycle, rinse cycle, etc.

Turning especially to FIG. 7, at 210, the method 200 includes rotating a wash basket within a wash tub at a basket speed. Continuing the example from above, wash basket 122 may be rotated by drive assembly 128 or motor assembly 130. In addition, the basket speed may be measured by motor assembly 130, e.g., by monitoring the back electromotive force (EMF) of the motor, or in any other suitable manner. The basket speed may be any suitable speed for plastering articles within the wash basket onto the wash basket or otherwise generating an out-of-balance (OOB) force.

In some embodiments, step 210 follows a wash cycle or rinse cycle and may, furthermore, follow a draining a volume of liquid from the tub. For instance, step 210 may occur after flowing a volume of liquid into the tub. The liquid may include water, and may further include one or more additives as discussed above. The water may be flowed through hoses, a tube, and nozzle assembly into the tub and onto articles that are disposed in the basket for washing. The volume of liquid may be dependent upon the size of the load of articles and other variables which may, for example, be input by a user interacting with the control panel and input selectors thereof.

Optionally, step 210 may occur after agitating articles within the tub (e.g., for an agitation period). During such agitation (which may be a sub-phase of the wash cycle), the volume of liquid flowed into the tub in may remain in the tub (i.e., before the volume of liquid is drained from tub). Moreover, during the agitation period, the basket may be rotated (e.g., at the tumble speed) or oscillated in alternating clockwise-counterclockwise rotation. The agitation period may be defined period of time programmed into the controller. The rotational or oscillation speed, pattern of agitation, and the agitation period may be dependent upon the size of the load of articles.

Method 200 further includes, at step 220, obtaining a front displacement amplitude and a rear displacement amplitude of the wash tub using a measurement device. Specifically, the front displacement amplitude may be measured near the front of the wash tub, e.g., proximate the counterweights 166. In addition, the rear displacement amplitude may be measured at the front bearing. According to exemplary embodiments, these displacement amplitudes may be determined by a measurement device including an accelerometer and a gyroscope. In such an embodiment, for example, the measurement device may be mounted at a convenient location on the outside of wash tub 120 and may be used for determining the displacement of any location on the rigid body of the tub, as described herein.

Step 230 includes obtaining a wobble angle of the wash tub. According to an exemplary embodiment, the wobble angle may be measured or determined using the gyroscope of measurement device 190 (e.g., via integration of detected rotational velocity data).

Step 240 includes determining a front bearing force amplitude threshold and a rear bearing force amplitude threshold as a function of the bearing force limits and the basket speed. Exemplary methods and equations for determining these bearing force amplitude thresholds are provided above. Notably, the bearing force limits are typically known, e.g., the force limit in pounds set by the bearing manufacturer. Similarly, the system constants needed for determining the bearing force amplitude thresholds are known values dependent on system configuration and geometry. Thus, the bearing force amplitude thresholds may be populated in a lookup table only as a function of the measured basket speed.

Step 250 includes calculating a front virtual bearing force value and a rear virtual bearing force value based in part on at least one of the front displacement amplitude, the rear displacement amplitude, and the wobble angle. Exemplary methods and equations for determining these virtual bearing force values are provided above, e.g., using the "bearing threshold equations" set forth above. It should be appreciated that variations and modifications may be made to such equations while remaining within the scope of the present subject matter. For example, when multiple displacement amplitudes are used, the particular mass and dimensional properties are used to calculate the virtual bearing force value. The properties scale, or weight, the multiple displacements amplitudes relative to each other. If only one displacement amplitude is needed, it could be said that the mass or dimensional property was incorporated into the threshold value.

Step 260 includes determining that the front virtual bearing force value is greater than the front bearing force amplitude threshold or the rear virtual bearing force value is greater than the rear bearing force amplitude threshold. If either of these conditions is satisfied, step 270 includes adjusting at least one operating parameter of the washing machine appliance. For example, step 270 may include maintaining or slowing the basket speed to reduce the forces generated at the bearing from an out-of-balance mass.

As used herein, an "operating parameter" of washing machine appliance 100 is any cycle setting, operating time, component setting, spin speed, part configuration, or other operating characteristic that may affect the performance of washing machine appliance 100. Thus, references to operating parameter adjustments or "adjusting at least one operating parameter" are intended to refer to control actions intended to improve system performance in response to out-of-balance masses, bearing forces, displacement amplitudes, wobble angle, etc. Basket spins speeds are used herein as exemplary adjusted operating parameters, but such use is not intended to limit the scope of operating parameter adjustments.

FIG. 7 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance.

Figure 8:
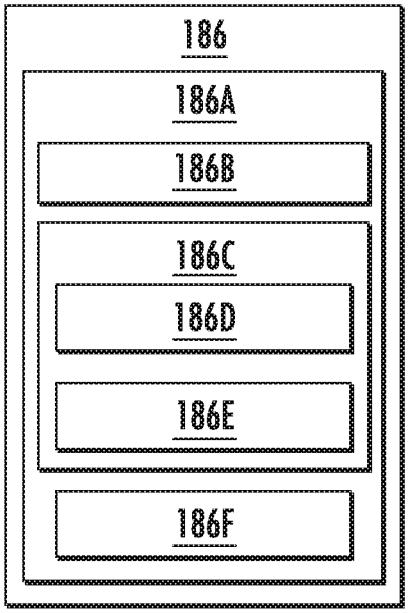
FIG. 8 depicts certain components of a controller according to example embodiments of the present subject matter.

FIG. 8 depicts certain components of controller 186 according to example embodiments of the present disclosure. Controller 186 can include one or more computing device(s) 186A which may be used to implement methods as described herein. Computing device(s) 186A can include one or more processor(s) 186B and one or more memory device(s) 186C. The one or more processor(s) 186B can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 186C can include one or more non-transitory computer-readable storage medium(s), such as RAM, ROM, EEPROM, EPROM, flash memory devices, magnetic disks, etc., and/or combinations thereof.

The memory device(s) 186C can include one or more computer-readable media and can store information accessible by the one or more processor(s) 186B, including instructions 186D that can be executed by the one or more processor(s) 186B. For instance, the memory device(s) 186C can store instructions 186D for running one or more software applications, displaying a user interface, receiving user input, processing user input, etc. In some implementations, the instructions 186D can be executed by the one or more processor(s) 186B to cause the one or more processor(s) 186B to perform operations, e.g., such as one or more portions of methods described herein. The instructions 186D can be software written in any suitable programming language or can be implemented in hardware. Additionally, and/or alternatively, the instructions 186D can be executed in logically and/or virtually separate threads on processor(s) 186B.

The one or more memory device(s) 186C can also store data 186E that can be retrieved, manipulated, created, or stored by the one or more processor(s) 186B. The data 186E can include, for instance, data to facilitate performance of methods described herein. The data 186E can be stored in one or more database(s). The one or more database(s) can be connected to controller 186 by a high bandwidth LAN or WAN, or can also be connected to controller through network(s) (not shown). The one or more database(s) can be split up so that they are located in multiple locales. In some implementations, the data 186E can be received from another device.

The computing device(s) 186A can also include a communication module or interface 186F used to communicate with one or more other component(s) of controller 186 or washing machine appliance 100 over the network(s). The communication interface 186F can include any suitable components for interfacing with one or more network(s), including for example, transmitters, receivers, ports, controllers, antennas, or other suitable components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance having a wash tub, a wash basket rotatably mounted within the wash tub by a drive shaft, and a front bearing and a rear bearing for supporting the drive shaft, the method comprising:

rotating the wash basket within the wash tub at a basket speed;

obtaining at least one displacement amplitude of the wash tub;

obtaining a wobble angle of the wash tub;

determining a bearing force amplitude threshold;

calculating a virtual bearing force value based in part on at least one of the displacement amplitude and the wobble angle;

determining that the virtual bearing force value is greater than the bearing force amplitude threshold; and adjusting at least one operating parameter of the washing machine appliance in response to determining that the virtual bearing force value is greater than the bearing force amplitude threshold.

2. The method of claim 1, wherein the bearing force amplitude threshold is a function of a bearing force limit and the basket speed.

3. The method of claim 2, wherein the bearing force amplitude threshold is a front bearing force amplitude threshold calculated using the following equation:

$$\mathrm{AMP}_{FRT} = \frac{F_{LMT_FRT}}{\omega^2 C_3}$$

where:

$\mathrm{AMP}_{FRT}$=the front bearing force amplitude threshold;

$F_{LMT_FRT}$=a front bearing force limit;

ω=the basket speed (radians/second); and $C_3$=$\mathrm{mass}_{rr}$, a known system constant.

4. The method of claim 3, wherein the at least one displacement amplitude comprises a front displacement amplitude at a front of the wash tub and a rear displacement amplitude at a rear of the wash tub.

5. The method of claim 4, wherein the virtual bearing force value is a front virtual bearing force value calculated using the following equation:

$$|\delta_{frt} C_4 + \cos(\beta)\delta_{rr}|$$

where:

$\delta_{frt}$=the front displacement amplitude;

$\delta_{rr}$=the rear displacement amplitude;

cos(β)=a component of $\delta_{rr}$ that is collinear with $\delta_{frt}$; and $$C_4 = \frac{\mathrm{mass}_{frt}}{\mathrm{mass}_{rr}}\left(1 + \frac{l_{frt}}{l_{rr}}\right),$$

a known system constant.

6. The method of claim 5, wherein cos(β) is calculated as follows:

$$\cos(\beta) = \frac{\delta_{frt}^2 + \delta_{rr}^2 - (\Phi \cdot l_{frt})^2}{2\delta_{frt}\delta_{rr}}$$

where:

Φ=the wobble angle; and $l_{frt}$=the distance between a tub front and the front bearing.

7. The method of claim 2, wherein the bearing force amplitude threshold is a rear bearing force amplitude threshold calculated using the following equation:

$$\mathrm{AMP}_{RR} = \frac{F_{LMT_RR}}{\omega^2 C_5}$$

where:

$\mathrm{AMP}_{RR}$=the rear bearing force amplitude threshold;

$F_{LMT_RR}$=a rear bearing force limit;

ω=the basket speed (radians/second); and $$C_5 = \mathrm{mass}_{frt}\left(\frac{l_{frt}}{l_{rr}}\right),$$

a known system constant.

8. The method of claim 7, wherein the at least one displacement amplitude comprises a front displacement amplitude at a front of the wash tub.

9. The method of claim 8, wherein the virtual bearing force value is a front virtual bearing force value calculated using the following equation:

$$|\delta_{frt}|$$

where:

$\delta_{frt}$=the front displacement amplitude.

10. The method of claim 9, wherein the bearing force amplitude threshold is a front bearing force amplitude threshold and the virtual bearing force value is a front virtual bearing force value, the method further comprising:

determining a rear bearing force amplitude threshold;

calculating a rear virtual bearing force value;

determining that the front virtual bearing force value is greater than the front bearing force amplitude threshold or the rear virtual bearing force value is greater than the rear bearing force amplitude threshold; and adjusting at least one operating parameter of the washing machine appliance in response to determining that the front virtual bearing force value is greater than the front bearing force amplitude threshold or the rear virtual bearing force value is greater than the rear bearing force amplitude threshold.

11. The method of claim 1, wherein adjusting at least one operating parameter of the washing machine appliance comprises:

maintaining the basket speed of the wash basket.

12. The method of claim 1, wherein adjusting at least one operating parameter of the washing machine appliance comprises:

reducing the basket speed of the wash basket or stopping the rotation of the wash basket.

13. The method of claim 1, wherein the washing machine appliance is a horizontal axis or front load washing machine appliance.

14. The method of claim 1, wherein the at least one displacement amplitude is measured using a measurement device, the measurement device comprising:

an accelerometer; and a gyroscope.

15. The method of claim 14, wherein the measurement device is mounted on a counterweight positioned at a front of the wash tub.

16. A washing machine appliance comprising:

a cabinet;

a wash tub positioned within the cabinet;

a measurement device operably coupled to the wash tub;

a wash basket rotatably mounted within the wash tub by a drive shaft supported by a front bearing and a rear bearing;

a drive assembly in mechanical communication with the wash basket for rotating the wash basket; and a controller communicatively coupled to the drive assembly and the measurement device, the controller configured for:

rotating the wash basket within the wash tub at a basket speed;

obtaining a front displacement amplitude and a rear displacement amplitude of the wash tub using the measurement device;

obtaining a wobble angle of the wash tub;

determining a front bearing force amplitude threshold and a rear bearing force amplitude threshold;

calculating a front virtual bearing force value and a rear virtual bearing force value based in part on at least one of the front displacement amplitude, the rear displacement amplitude, and the wobble angle;

determining that the front virtual bearing force value is greater than the front bearing force amplitude threshold or the rear virtual bearing force value is greater than the rear bearing force amplitude threshold; and adjusting at least one operating parameter of the washing machine appliance in response to determining that the front virtual bearing force value is greater than the front bearing force amplitude threshold or the rear virtual bearing force value is greater than the rear bearing force amplitude threshold.

17. The washing machine appliance of claim 16, wherein the front bearing force amplitude threshold calculated using the following equation:

$$\mathrm{AMP}_{FRT} = \frac{F_{LMT_FRT}}{\omega^2 C_3}$$

where:

$\mathrm{AMP}_{FRT}$=the front bearing force amplitude threshold;

$F_{LMT_FRT}$=a front bearing force limit;

ω=the basket speed (radians/second); and $C_3$=$\mathrm{mass}_{rr}$, a known system constant.

18. The washing machine appliance of claim 17, wherein the front virtual bearing force value calculated using the following equation:

$$|\delta_{frt} C_4 + \cos(\beta)\delta_{rr}|$$

where:

$\delta_{frt}$=the front displacement amplitude;

$\delta_{rr}$=the rear displacement amplitude;

$$C_4 = \frac{\mathrm{mass}_{frt}}{\mathrm{mass}_{rr}}\left(1 + \frac{l_{frt}}{l_{rr}}\right),$$

a known system constant;

$$\cos(\beta) = \frac{\delta_{frt}^2 + \delta_{rr}^2 - (\Phi \cdot l_{frt})^2}{2\delta_{frt}\delta_{rr}};$$

Φ=the wobble angle; and $l_{frt}$=the distance between a tub front and the front bearing.

19. The washing machine appliance of claim 15, wherein the rear bearing force amplitude threshold calculated using the following equation:

$$\mathrm{AMP}_{RR} = \frac{F_{LMT_RR}}{\omega^2 C_5}$$

where:

$\mathrm{AMP}_{RR}$=the rear bearing force amplitude threshold;

$F_{LMT_RR}$=a rear bearing force limit;

ω=the basket speed (radians/second);

$$C_5 = \mathrm{mass}_{frt}\left(\frac{l_{frt}}{l_{rr}}\right),$$

a known system constant $l_{frt}$=the distance between a tub front and the front bearing; and $l_{rr}$=the distance between the front bearing and a rear bearing.

20. The washing machine appliance of claim 19, wherein the virtual bearing force value is a front virtual bearing force value calculated using the following equation:

$$|\delta_{frt}|$$

where:

$\delta_{frt}$=the front displacement amplitude.

* * * * *